US010042299B2

(12) United States Patent
Kozuma

(10) Patent No.: US 10,042,299 B2
(45) Date of Patent: Aug. 7, 2018

(54) IMAGE HEATING APPARATUS

(71) Applicant: CANON KABUSHIKI KAISHA, Tokyo (JP)

(72) Inventor: Takeshi Kozuma, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/479,501

(22) Filed: Apr. 5, 2017

(65) Prior Publication Data

US 2017/0205747 A1 Jul. 20, 2017

Related U.S. Application Data

(63) Continuation of application No. PCT/JP2015/079105, filed on Oct. 7, 2015.

(30) Foreign Application Priority Data

Oct. 8, 2014 (JP) ..... 2014-207005

(51) Int. Cl.
*G03G 15/20* (2006.01)

(52) U.S. Cl.
CPC ..... *G03G 15/2085* (2013.01)

(58) Field of Classification Search
CPC ..... G03G 15/2085
USPC ..... 285/1
See application file for complete search history.

(56) References Cited

U.S. PATENT DOCUMENTS 5,520,418 A * 5/1996 Burke ..... F16L 35/00 137/614.05
8,660,474 B2 2/2014 Seto et al.
9,069,299 B2 6/2015 Tanaka
9,354,562 B2 5/2016 Tanaka
2011/0206425 A1* 8/2011 Seto ..... G03G 21/206 399/323

(Continued)

FOREIGN PATENT DOCUMENTS

EP 0 997 330 A1 3/2000
JP S60-247672 A 12/1985

(Continued)

OTHER PUBLICATIONS

PCT International Search Report and Written Opinion dated Jan. 19, 2016, in PCT/JP2015/079105, and partial translation.

(Continued)

*Primary Examiner* — Ryan Walsh

(74) *Attorney, Agent, or Firm* — Fitzpatrick, Cella, Harper & Scinto

(57) ABSTRACT

An image heating apparatus includes first and second rotatable members configured to form a nip for heating a toner image on a sheet, a compressor, an air nozzle configured to blow air, generated by the compressor, on the first rotatable member, and a supplying mechanism configured to supply the air from the compressor to the air nozzle, the supplying mechanism including a plurality of air tubes and a plurality of clamps for clamping the air tubes at a plurality of different clamping positions. The plurality of clamping portions includes a predetermined clamping portion capable of being unclamped by a predetermined internal pressure lower by 20% or more than an internal pressure by which any other clamping portion, of the plurality of clamping portions, is unclamped.

18 Claims, 7 Drawing Sheets

(56) References Cited

U.S. PATENT DOCUMENTS

| | | | | |
|---|---|---|---|---|
| 2011/0211875 | A1* | 9/2011 | Takeshita | G03G 15/2028 399/323 |
| 2013/0101324 | A1* | 4/2013 | Yamamoto | G03G 15/0189 399/323 |
| 2017/0010568 | A1 | 1/2017 | Kozuma | |

FOREIGN PATENT DOCUMENTS

| | | | |
|---|---|---|---|
| JP | 2000-130896 | A | 5/2000 |
| JP | 2007-094327 | A | 4/2007 |
| JP | 2012-037854 | A | 2/2012 |
| JP | 2014-132330 | A | 7/2014 |
| JP | 5633258 | B2 | 12/2014 |
| JP | 5861374 | B2 | 2/2016 |
| WO | 2014/136536 | A1 | 9/2014 |

OTHER PUBLICATIONS

Extended European Search Report dated Apr. 24, 2018, issued in Patent Application No. 15848607.6.
Notice of Allowance dated Apr. 24, 2018, issued in corresponding Korean Patent Application No. 10-2017-7011150.

* cited by examiner

IMAGE HEATING APPARATUS

TECHNICAL FIELD

This application is a continuation of PCT Application No. PCT/JP2015/079105, filed Oct. 7, 2015.

The present invention relates to an image heating apparatus for heating a toner image on a sheet.

BACKGROUND ART

An image forming apparatus in which the toner image is formed on a recording material (sheet) and the recording material on which the toner image is formed is heated and pressed by a fixing device (image heating apparatus) and an image is fixed on the recording material has been widely used. In such a fixing device, at a nip formed by a pair of rotatable members, a fixing process is carried out.

In the case in which the recording material is thin and low in rigidity, the recording material is not readily separated from the rotatable members. For this reason, a proposal that an air nozzle is provided in the neighborhood of the rotatable members and the recording material is forcedly separated from the rotatable members by blowing air, supplied from a compressor, from the air nozzle onto the recording material has been made (Japanese Laid-Open Patent Application SHO 60-247672, Japanese Laid-Open Patent Application 2007-94327).

In an air supplying path from the compressor to the air nozzle, many air tubes are provided for being connected between devices. These air tubes are fixed by clamps in a state in which the air tubes are inserted into the devices, and during operation, are constituted so as not be unclamped when the air tubes are in a normal condition.

On the other hand, in the case in which a pressure in the air supplying path is excessively increased by breakage of the device, there is a liability that the air tube is unclamped against a clamp fastening force.

In such a case, a recovery operation is to be carried out, but when all of the portions, in which many air tubes are connected, are checked thoroughly, the recovery operation requires a long time.

SUMMARY OF THE INVENTION

According to an aspect of the present invention, there is provided an image heating apparatus comprising: first and second rotatable members for forming a nip for heating a toner image on a sheet; a compressor; an air nozzle for blowing air, generated by the compressor, on the first rotatable member; and a supplying mechanism for supplying air from the compressor to the air nozzle, the supplying mechanism including a plurality of air tubes and a plurality of clamps for fixing the plurality of air tubes, wherein a pressure at which the air tube is unclamped is lower only at a predetermined portion of the clamped portions than the other portions by 20% or more.

EMBODIMENTS FOR CARRYING OUT THE INVENTION

In the following, with reference to the drawings, an embodiment of the present invention will be described specifically.

Embodiment 1

Image Forming Apparatus

Figure 1:
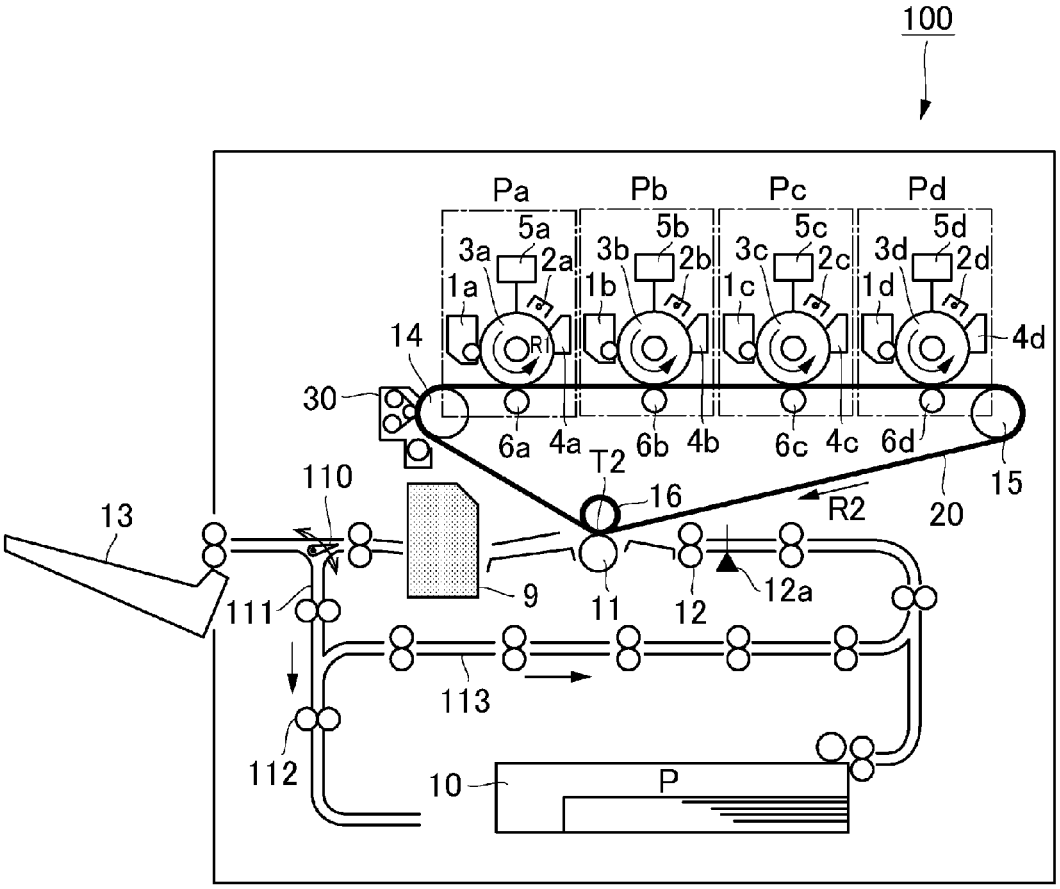
FIG. 1 is an illustration of a structure of an image forming apparatus.

FIG. 1 is an illustration of a structure of an image forming apparatus. As shown in FIG. 1, an image forming apparatus 100 is a tandem-type full-color printer of an intermediary transfer type in which image forming apparatus Pa, Pb, Pc, Pd of yellow, magenta, cyan, black are arranged along an intermediary transfer belt 20.

At the image forming portion Pa, a yellow toner image is formed on a photosensitive drum 3*a* and is primary-transferred onto the intermediary transfer belt 20. At the image forming portion Pb, a magenta toner image is formed on a photosensitive drum 3*b* and is primary-transferred onto the intermediary transfer belt 20. At the image forming portion Pc and Pd, a cyan toner image and a black toner image are formed on the photosensitive drums 3*c* and 3*d*, respectively, and are primary-transferred onto the intermediary transfer belt 20.

A recording material (sheet) P is taken out one by one from a cassette 10 and is on stand-by at a registration roller 12. The recording material P is fed by the registration roller 12 to a secondary transfer portion T2 in timing with the toner images on the intermediary transfer belt 20, and the toner images are secondary-transferred onto the recording material P. The recording material P on which the toner images of the four colors are secondary-transferred is fed to a fixing device 9 and is heated and pressed by the fixing device 9, so that an image is fixed on a surface of the recording material P, and thereafter is discharged on a tray 13 outside the apparatus.

In double-side printing, the recording material P, on which the images are fixed at a front surface thereof by the fixing device 9, is sent into a reverse feeding path and is switched back, and then passes through a transfer feeding path 113 in a state in which a leading end and a trailing end are reversed and in which the front surface and a back surface are reversed, and is on stand-by at the registration roller 12. Then, the recording material P is fed again to the secondary transfer portion T2, in which the toner images are transferred onto the back surface of the recording material P and are fixed on the back surface of the recording material P by the fixing device 9, and thereafter, the recording material P is discharged on the tray 13 at an outer portion of the apparatus 100 (printer).

Image Forming Portion

The image forming portions Pa, Pb, Pc, Pd have substantially the same constitution except that the colors of the toners used in developing devices 1*a*, 1*b*, 1*c*, 1*d* are yellow, magenta, cyan, black, respectively, which are different from each other. In the following, the image forming portion Pa for yellow will be described, and redundant description relating to the other image forming portions Pb, Pc, Pd will be omitted.

At the image forming portion Pa, at a periphery of the photosensitive drum 3*a*, a corona charger 2*a*, an exposure device 5*a*, the developing device 1*a*, a transfer roller 6*a* and a drum cleaning device 4*a* are provided.

The corona charger 2*a* electrically charges a surface of the photosensitive drum 3*a* to a uniform potential. The exposure device 5*a* writes the electrostatic image for the image on the photosensitive drum 3*a* by scanning the photosensitive drum surface with a laser beam. The developing device 1*a* develops the electrostatic image into the toner image on the photosensitive drum 3*a* by transferring the toner on the electrostatic image on the photosensitive drum 3*a*. The transfer roller 6*a* primary-transfers the toner image from the photosensitive drum 3*a* onto the intermediary transfer belt 20 under application of a voltage of an opposite polarity to a charge polarity of the toner.

The intermediary transfer belt 20 is extended around and supported by a tension roller 14, a driving roller 15 and an opposing roller 16, and is driven by the driving roller 15, so that the intermediary transfer belt 20 rotates in a direction indicated by arrow R2. A secondary transfer roller 11 press-contacts the intermediary transfer belt 20 supported by the opposing roller 16 and forms the secondary transfer portion T2. A belt cleaning device 30 rubs the intermediary transfer belt 20 with a cleaning web and thus removes transfer residual toner that remains on the intermediary belt 20 after passing the secondary transfer portion T2.

(Fixing Device)

Figure 2:
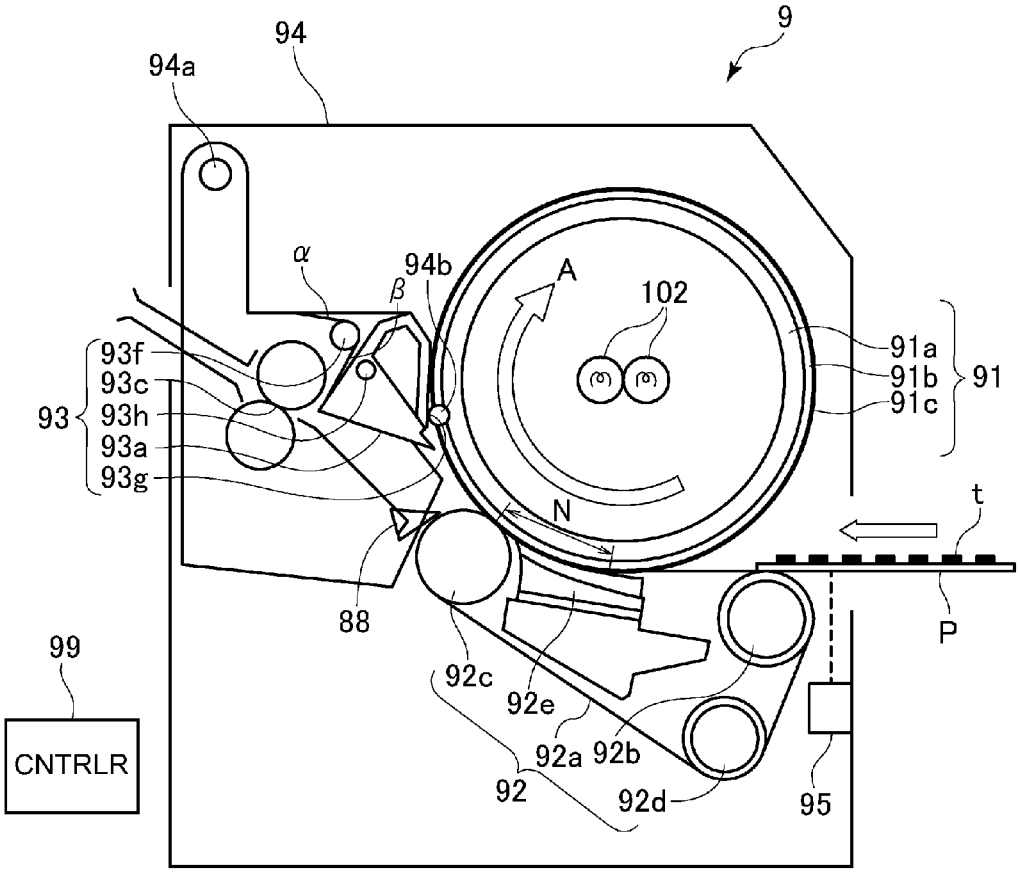
FIG. 2 is an illustration of a structure of a fixing device.

FIG. 2 is an illustration of a structure of the fixing device 9 functioning as an image heating apparatus. As shown in FIG. 2, the recording material P on which the toner image is transferred is fed by a pressing belt 92*a* and is introduced into a fixing nip N, and is nipped and fed by a fixing roller 91 and a pressing belt unit 92. The toner image on the recording material P is heated and pressed in a process of passing through the fixing nip N, so that the toner image is fixed on the surface of the recording material. The fixing device 9 causes the pressing belt unit 92 to press-contact the fixing roller 91, so that the fixing nip is formed between the fixing roller 91 and the pressing belt unit 92. The fixing roller 91 and the pressing belt unit 92, which are an example of pair of rotatable members, heat the recording material on which the toner image is carried.

The fixing roller 91 includes a metal core 91*a* formed of a cylindrical metal, a heat-resistant elastic layer 91*b* disposed in an outer side of the metal core 91*a*, and a parting layer 91*c* of a heat-resistant fluorine-containing resin material coated on an outer peripheral surface of the elastic layer 91*b* in order to improve a toner parting property. The metal core 91*a* is an aluminum-mode cylindrical material of 77 mm in outer diameter, 6 mm in thickness, and 350 mm in length. The elastic layer 91*b* is a 1.5 mm-thick silicone rubber of 20 degrees in JIS-A hardness. The parting layer 91*c* is a 50 μm-thick PFA tube.

The fixing roller 91 is rotatably supported at both end portions by a fixing device frame 94, and is rotationally driven at a predetermined speed (e.g., 500 mm/s in peripheral speed) in an arrow A direction by an unshown driving source.

Inside the metal core 91*a*, a halogen heater 102 of 1200 W in (normal) related electric power heats the fixing roller 91 from the inside of the fixing roller 91. Electric power supply of the halogen heater 102 is controlled by an unshown temperature control circuit so that a surface temperature of the fixing roller 91 measured by an unshown thermistor is maintained at a target temperature by temperature adjustment.

The pressing belt 92*a* is an endless belt of 70 mm in outer diameter such that a 200 μm-thick elastic layer of a silicone rubber is disposed on a 100 μm-thick base layer formed of polyimide.

The pressing belt 92*a* is stretched by an entrance roller (driving roller) 92*b*, a separation roller 92*c*, a steering roller 92*d* and a photosensitive drum pad 92*e*. The pressing belt 92*a* is rotationally driven by a driving force inputted from an unshown driving source into the entrance roller 92*b*.

The separation roller 92*c* presses the pressing belt 92*a* toward the fixing roller 91 by being urged at both end portions by an unshown pressing mechanism (spring). The separation roller 92*c* carries out pressing of 490 N (50 kgf) in total.

The pressing pad 92*e* presses the pressing belt 92*a* toward the fixing roller 91 by being urged at both end portions by an unshown pressing mechanism (spring). The pressing pad 92*e* carries out pressing of 490 N (50 kgf) in total.

(Separation of Recording Material)

A conventional fixing device nips and feeds the recording material, on which the toner image is carried, by the fixing roller and the pressing belt, so that the image is fixed on the recording material. In the fixing device, an unfixed toner image formed on the recording material directly contacts the surface of the fixing roller, and therefore, there is a possibility that the recording material sticks to the fixing roller due to viscosity of melted toner and is moved without being peeled off from the fixing roller. By this arrangement, there is a possibility that a jam of the recording material is caused.

The fixing device peels off the recording material sticking to the fixing roller by causing a separation claw, formed of a heat-resistant resin material, to contact and rub the surface of the fixing roller. On the separation claw, there is a need to exert a small pressing force in order to be closely contacted to the fixing roller.

However, in the conventional fixing device, when the small pressing force is exerted on the separation claw by causing the separation claw to contact the fixing roller, a peripheral surface of the fixing roller sliding with a free end of the separation claw is locally abraded. When a hard foreign matter is deposited on the separation claw, there is a possibility that the surface layer of the fixing roller is damaged.

Further, in the case in which the recording material is thin paper small in weight per unit area, there is a possibility that a leading end portion of the recording material runs against the separation claw and is damaged, and generates creases, folds or breakage. In order to solve such problems, in Embodiment 1, compressed air is blown onto the leading end of the recording material P on the fixing roller 91, so that the recording material P is peeled off.

(Discharging Unit)

A discharging unit 93 is disposed downstream of the fixing nip N with respect to a recording material feeding direction. The discharging unit 93 separates the recording material P, passed through the fixing nip N, from the fixing roller 91 by high-pressure air blast by an air nozzle 93*a*, and discharges the recording material P to an outside of the fixing device 9 by a feeding roller pair 93*c*.

The air nozzle 93*a* blows high-pressure air onto the leading end of the recording material P, on the fixing roller 91, after passing through the fixing nip N, and peels off the recording material P from the fixing roller 91. The feeding roller pair 93*c* nips and feeds the peeled recording material P and discharges the recording material P to the outside of the fixing device 9.

The discharging unit 93 is rotatable about a rotation center 94*a* of the fixing device frame 94. The discharging unit 93 is rotatable between a disposing position where the discharging unit 93 is disposed when the fixing device 9 performs a fixing operation and a retracted position where the discharging unit 93 is rotated and retracted from the fixing roller 91 when the recording material P remaining in the fixing device 9 is removed during jam clearance. The discharging unit 93 is rotated and raised to the retracted position, whereby a space ensuring an unobstructed view from a downstream side is formed in the downstream side of the fixing nip N, so that the recording material P which has not been discharged can be discharged.

The air nozzle 93*a* is supported by the discharging unit 93 rotatably about a nozzle rotation center 93*h*, and is pressed by a movable end β of a helical torsion coil spring 93*f* with a fixed end α. To the fixing device frame 94, a nozzle positioning pin 94*b* is fixed. When the discharging unit 93 is disposed in the fixing device 9, an abutting surface 93*g* of the air nozzle 93*a* abuts against the nozzle positioning pin 94*b*, so that the air nozzle 93*a* is positioned relative to the fixing roller 91.

In the case in which a weight per unit area of the recording material P is 128 g/m$^2$ or less, a controller 99 discriminates that peeling by compressed air is needed. When the recording material P is sent into the fixing device 9, a recording material detecting sensor 95 detects the leading end of the recording material P. The controller 99 causes the air nozzle 93*a* to blow the compressed air onto the leading end of the recording material P on the fixing roller 91 at a speed of about 300 m/sec after a lapse of a predetermined time on the basis of timing when the recording material detecting sensor 95 detected the leading end of the recording material P, and peels off the recording material P from the fixing roller 91.

(High-Pressure Air Path)

Figure 3:
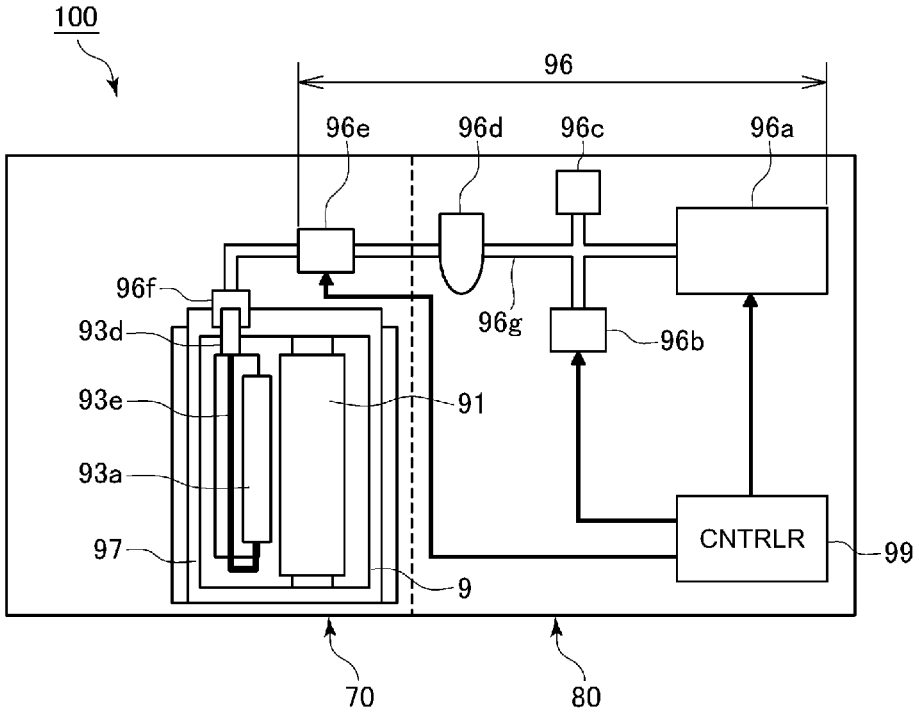
FIG. 3 is an illustration of a high-pressure air path of the image forming apparatus.

FIG. 3 is an illustration of a high-pressure air path of the image forming apparatus. As shown in FIG. 3, the fixing device 9 in which the discharging unit 93 is mounted is disposed by being shifted toward a front (surface) side of the image forming apparatus 100. A high-pressure air path 96 forms part of an air supplying mechanism for supplying the compressed air to the discharging unit 93, and is disposed by being shifted toward a rear (surface) side of the image forming apparatus 100.

Figure 4:
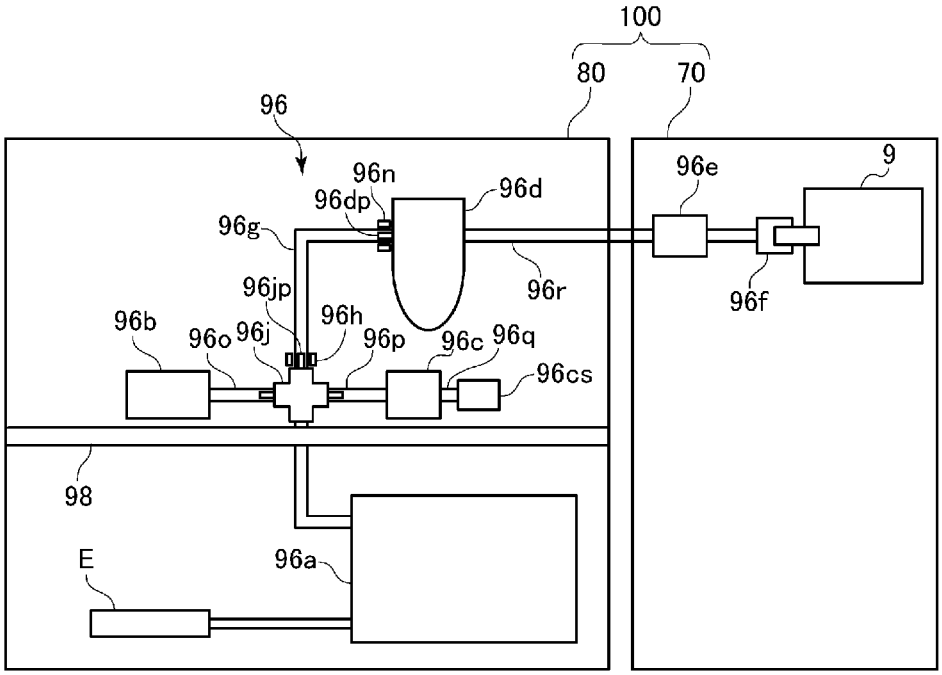
FIG. 4 is an illustration of an arrangement of air tubes.

As shown in FIG. 3, in the high-pressure air path 96 as a part of the air supplying mechanism for supplying the air from a compressor 96*a* to the air nozzle 93*a*, at least a solenoid (electromagnetic) valve 96*e* functioning as a pressure limiting mechanism and a pressure adjusting valve 96*c* are provided. The compressor 96*a* generates high-pressure air that is blown by the air nozzle 93*a*. The air compressor 96*a* is provided in a casing of the image forming apparatus 100 and compresses ambient air and supplies the compressed air to the high-pressure air path 96. As shown in FIG. 4, a joint part (component) 96*j*, which is an example of a relay member, relays an air tube 96*g*.

A pressure-heating solenoid valve 96*b*, which also serves as the pressure limiting mechanism, discharges the high-pressure air in the high-pressure air path 96 to the outside. The controller 99 actuates the pressure-heating solenoid valve 96*b* during actuation of the compressor 96*a* and lowers the pressure in the high-pressure air path 96 to atmospheric pressure, so that an actuating torque of the compressor 96*a* is decreased to a small value. An air filter 96*d* separates and discharges, to a drain, water, dirt and dust contained in the high-pressure air discharged by the air compressor 96*a*.

The solenoid valve 93*e* switches between supply and non-supply of the high-pressure air to the air nozzle 93*a*. The solenoid valve 93*e* is connected with a main assembly-side coupler 96*f* by the air tube 96*g* and sends the high-pressure air, in the high-pressure air path 96, to the air nozzle 93*a*. The air nozzle 93*a*, which is an example of an air nozzle, is capable of blowing the high-pressure air onto the fixing roller 91. The air nozzle 93*a* blows the high-pressure air onto the leading end of the recording material P and separates the recording material P from the fixing roller 91. The main assembly-side coupler 96*f* is detachably connected to a fixing-side coupler 93*d*. The high-pressure air supplied from the main assembly-side coupler 96*f* to the discharging unit 93 through the fixing-side coupler 93*d* is blown from the air nozzle 93*a* onto the fixing roller 91.

The controller 99 actuates the air compressor 96*a* and, thereafter, closes the pressure-heating solenoid valve 96*b*. Then, compressed air with a pressure P2 adjusted by the pressure adjusting valve 96*c* is accumulated in the high-pressure air path 96 from the compressor 96*a* to the solenoid valve 96*e*.

The pressure adjusting valve 96*c* regulates (adjusts) the pressure of the high-pressure air supplied to the air nozzle 93*a* to a first pressure P2. The pressure adjusting valve 96*c* discharges the high-pressure air, in the high-pressure air path 96, to the outside air at the pressure P2 when the pressure in the high-pressure air path 96 reaches the pressure P2, so that the pressure adjusting valve 96*c* maintains the pressure, in the high-pressure air path 96 ranging to the solenoid valve 96*e*, at the pressure P2. The solenoid valve 96*e* is adjusted so that the pressure P2 is about 0.3 MPa.

The controller 99 actuates the solenoid valve 96*e* so that the recording material P is separated from the fixing roller 91. The controller 99 turns on the solenoid valve 96*e* immediately before the leading end of the recording material P reaches a blowing position on the fixing roller 91, and starts blowing the high-pressure air, accumulated in the high-pressure air path 96 and having the pressure P2, onto the leading end of the recording material P. Thereafter, the supply of the high-pressure air by the compressor 96*a* cannot catch up with an amount of flow from the air nozzle 93*a*, so that a blowing pressure of the high-pressure air in the high-pressure air path 96 drastically lowers. The controller 99 turns off the solenoid valve 96*e* at a portion of about ⅓ of a length of the recording material P with respect to the feeding direction and accumulates the high-pressure air with the pressure Ps in the high-pressure air path, and prepares for a leading end of a subsequent recording material P.

(Mounting Structure of Air Tube)

Figure 5:
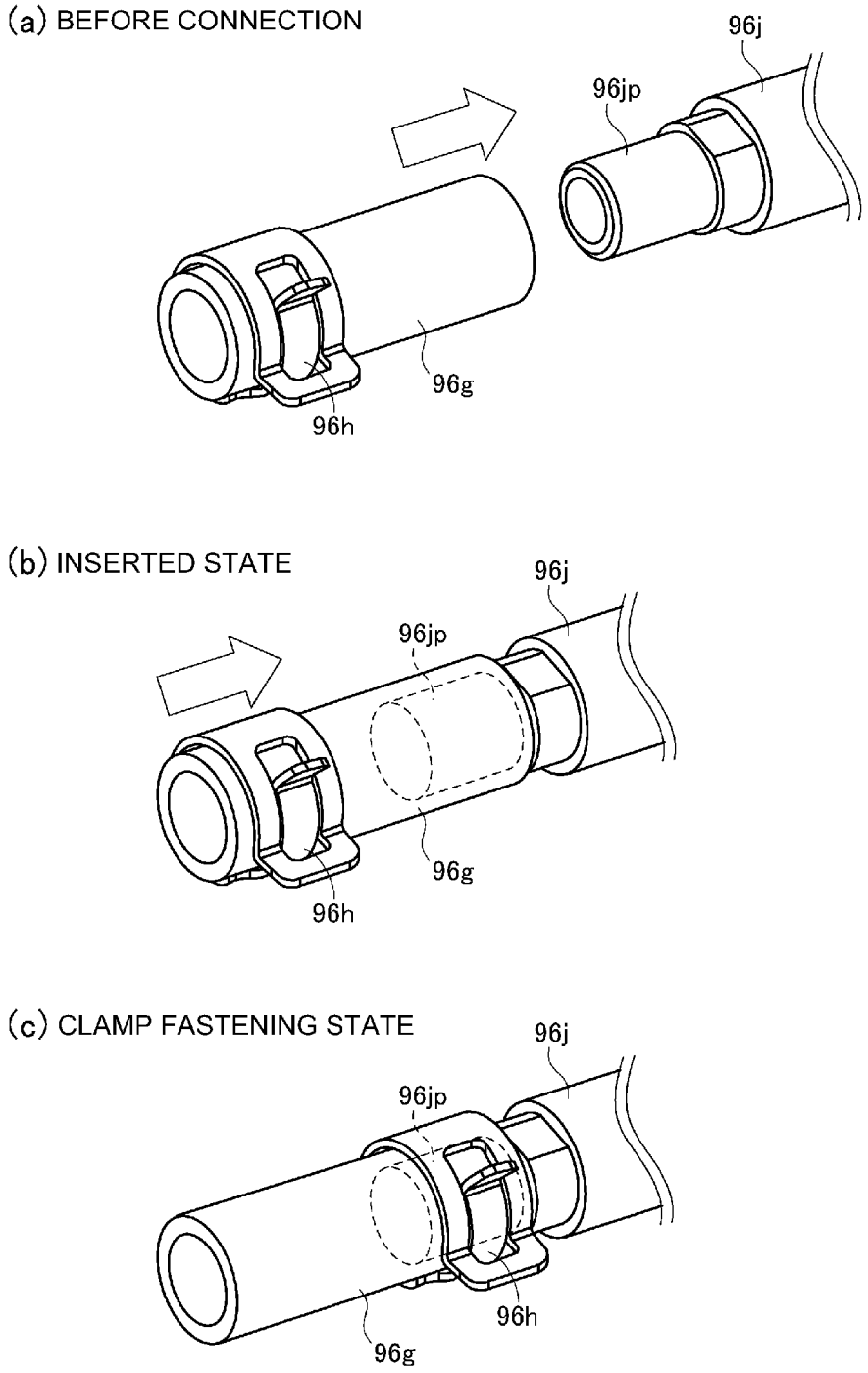
FIG. 5 includes illustrations of an air tube mounting structure.

FIG. 4 is an illustration of an arrangement of the air tube. FIG. 5 includes illustrations of an air tube mounting structure. As shown in FIG. 4, in the image forming apparatus 100, a casing of a compressor unit 80, separable from a main assembly casing in which the fixing device 9 is mounted, is provided. The image forming apparatus 100, which is an example of a first casing, accommodates the air nozzle 93*a* and the solenoid valve 96*e*. The compressor unit 80, which is an example of a second casing, is detachably mountable to the image forming apparatus 100 and accommodates the compressor 96*a* and the pressure adjusting valve 96*c*. The casing of the compressor unit 80 is partitioned by a partition wall 98 into a space in the compressor 96*a* side and a space in the air filter 96*d* side.

To the partition wall 98, the joint part 96*j* for relaying piping of the high-pressure air path 96 is fixed. The joint part 96*j* is fixed to the partition wall 98 and relays the supply of the high-pressure air supplied from the compressor 96*a*. A cylindrical portion 96*jp* is a connected portion of the high-pressure air path 96 with the joint part 96*j*. The joint part 96*j* and the air filter 96*d* are connected by the air tube 96*g*. An end portion of the air tube 96*g* formed with a silicone rubber is fit on the cylindrical portion 96*jp*, formed of alumina, of the joint part 96*j*. The end portion of the air tube 96*g* is fixed to the joint part 96*j* by fastening (clamping) an outside (portion) of the air tube 96*g* with a tube clamp 96*h*. The tube clamp 96*h* is of a leaf spring type, and increases in inner diameter by pressing both end grips in an approaching direction and decreases in inner diameter by releasing the pressure application of the both end grips thereby to fasten the air tube 96*g*.

As shown in FIG. 5, the air tube 96*g* is fixed to the cylindrical portion 96*jp* of the joint part 96*j* in the following procedure.

(1) An operator fits the tube clamp 96*h* on the air tube 96*g* at a position somewhat remote from the end portion of the air tube 96*g* in advance. The tube clamp 96*h* is of the leaf spring type, and when the grip portions of the tube clamp 96*h* are caught using a tool, such as a long-nose plier, the inner diameter of the tube clamp 96*h* is enlarged, so that the tube clamp 96*h* is slidable in an axial direction.

(2) The operator fits the air tube 96*g* on the cylindrical portion 96*jp* and pushes the air tube 96*g* to a predetermined position.

(3) The operator slides the tube clamp 96*h* along the air tube 96*g* in a state in which the inner diameter of the tube clamp 96*h* is enlarged, and positions the tube clamp 96*h* at an engaging portion with the cylindrical portion 97*jp*.

(4) The operator releases the pressure application to the grip portions of the tube clamp 96*h*. By this, the inner diameter of the tube clamp 96*h* decreases, and a fastening force acts on the air tube 96*g*, so that the air tube 96*g* is fixed to the cylindrical portion 96*jp*.

As shown in FIG. 4, also a connected portion between the air tube 96 and the air filter 96*d* is fixed using a similar constitution. An opposite end portion of the air tube 96*g* from the joint part 96*j* is fit on a cylindrical portion 96*dp*, formed of aluminum, of the air filter 96*d*, and the outside of the air tube 96*g* is fastened (clamped) by a tube clamp 96*n*.

As shown in FIG. 4, in the high-pressure air path 96, also between pneumatic (air pressure) elements other than between the joint part 96*j* and the air filter 96*d*, connection is made similarly using air tubes 96*o*, 96*p*, 96*q* and 96*r*.

(Problem of High-Pressure Air Path)

As shown in FIG. 3, in the case in which the high-pressure air for separating the recording material P from the fixing roller 91 is generated by the air compressor 96*a*, the pressure in the high-pressure air path 96 is maintained at an operating pressure (first pressure) by the pressure adjusting valve 96*c*. For this reason, the air tube 96*g* of the high-pressure air path 96 is not unclamped (and does not fall off) from the cylindrical portions 96*jp* and 96*dp* due to an internal pressure of the air tube 96*g* by which the fastening forces of the tube clamps 96*h* and 96*n* are overpowered.

However, in the case in which the pressure adjusting valve 96*c* causes clogging, there is a possibility that the pressure in the air tube 96*g* exceeds the pressure P2 and increases up to a maximum discharge pressure P1 of the compressor 96*a*. When the internal pressure of the air tube 96*g* increases, the tube clamps 96*h* and 96*n* cannot withstand the internal pressure of the air tube 96*g*. The air tube 96*g* floats from the cylindrical portions 96*jp* and 96*dp* by the pressure, so that there is a possibility that the air tube 96*g* is unclamped (and falls off) from one of the cylindrical portions 96*jp* and 96*dp*.

Further, in the high-pressure air path 96, also between devices other than between the joint part 96*j* and the air filter 96*d*, connection is made similarly using the air tubes 96*o*, 96*p*, 96*q* and 96*r*, and therefore, there is a possibility that also at any other connected portion, the air tube is unclamped. A phenomenon that the air tube is unclamped by the internal pressure can generate at every portion of the high-pressure air path 96.

When the air tube is unclamped by the internal pressure, determining which end portion of which air tube in the high-pressure air path 96 is unclamped requires that all of the connected portions of the high-pressure air path 96 are checked thoroughly. When all of the connected portions of the high-pressure air path 96 are checked thoroughly, it takes time to identify the cause, so that a device recovery maintenance property by a service person becomes poor.

Therefore, in this embodiment, the pressure at which one end portion of the air tube 96*g* connected with the joint part 96*j* is unclamped at the connected portion is intentionally made smaller by 20% or more compared with the pressure at which all of the other air tubes 96*o*, 96*p*, 96*q*, 96*r*, are unclamped at the connected portions. By this arrangement, when the pressure adjusting valve 96*c* clogs and the pressure in the high-pressure air path 96 increases, the air tube 96*g* is unclamped only at one connected portion low in unclamping pressure, so that the pressure in the high-pressure air path 96 is released, and therefore, further pressure increase of the high-pressure air path 96 is prevented.

A plurality of connected portions (air tube clamped portions) in the high-pressure air path 96 includes at least one tube connected portion where the end portion of the air tube is fit on a tubular portion provided at a connected end of the connected portion and is externally fastened by a tube-like clamp, which is an example of a fastening member. Further, when a discharge pressure of the compressor 96*a* is P1, the first pressure is P2, and the pressure in the high-pressure air path 96, at which the end portion of the air tube 96*g* is unclamped from the cylindrical portion 96*jp* at one tube connected portion, is P3, the relationship of P1>P3>P2 holds. All of the connected portions in the high-pressure air path 96, other than the one tube connected portion, are constituted so as to withstand static pressure larger than P3 by 20% or more.

(Experimental Result)

Figure 6:
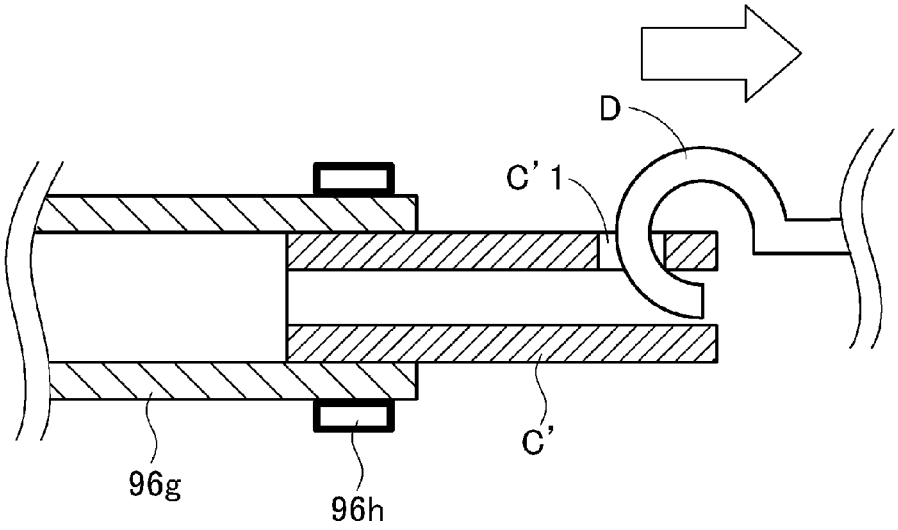
FIG. 6 is an illustration of an unclamping strength test of the air tube.

FIG. 6 is an illustration of an unclamping strength test of the air tube. In Embodiment 1, the unclamping pressure of the connected portion in the joint part 96*j* side of the air tube 96*g* connecting the joint part 96*j* for relaying piping and the air filter 96*d* was set so as to be lower than that of the connected portion in the air filter 96*d* side by 20% or more.

The air tube 96*g* is prepared by cutting a tube material of about 15 mm in outer diameter, about 9 mm in inner diameter and formed of a silicone rubber, into a necessary length. The cylindrical portion 96*jp* of the joint part 96, to which one end of the air tube 96*g* is connected, is formed to have a smooth peripheral surface free from unevenness and having an outer diameter of about 8.5 mm. The cylindrical portion 96*dp* of the air filter 96*d*, to which the other end of the air tube 96*g* is connected, is formed to have a smooth peripheral surface free from unevenness and having an outer diameter of about 9.5 mm.

As shown in FIG. 4, the air tubes 96*o*, 96*p*, 96*q*, and 96*r*, provided between the devices other than between the joint part 96*j* and the air filter 96*d*, were prepared by cutting the same materials as that of the air tube 96*g* into necessary lengths, respectively. Both end portions of each of the air tubes 96*o*, 96*p*, 96*q*, and 96*r* are constituted similarly as the connected portions of the air tube 96*g* and the air filter 96*d*, and similar unclamping pressure is set, and both end portions were connected to corresponding pneumatic elements.

The clamps 96*h* and 96*n* of the leaf spring type are about 13 mm in inner diameter when the pressure application to the grip portions is released, and are about 16 mm in maximum inner diameter when the grip portions are pressed.

The inner diameter of 9 mm of the air tube 96*g* exceeds the outer diameter of 8.5 mm of the cylindrical portion 96*jp* to be connected. However, by fastening the outer periphery of the air tube 96*g* with the tube clamp 96*h*, the high-pressure air is prevented from leaking out from a gap between the air tube 96*g* and the cylindrical portion 96*jp*.

Insertion lengths of the air tube 96*g* into the cylindrical portions 96*jp* and 96*dp* are each about 12 mm, and also widths of the tube clamps 96*h* and 96*n* with respect to an insertion direction are about 12 mm.

As shown in FIG. 6, a sample which reproduces a connection state of the air tube 96*g* at both end portions was prepared, and the unclamping strength was compared by a tensile test.

A test cylindrical member C' is formed of the same material as the cylindrical portion 96*jp* which is a connection destination of the air tube 96*g* and is 8.5 mm in outer diameter which is the same as that of the cylindrical portion 96*jp*, and a through hole C'1 for locking a hook portion D of a digital force gauge is formed.

An end portion of the test cylindrical member C' is inserted into the air tube 96*g*, and an end portion of the test cylindrical member C' in a side opposite from the air tube 96*g* is fixed by an unshown fixing means. Then, from a state in which the tube clamp 96*h* is mounted and a fastening force is exerted on the air tube 96*g* and the cylindrical member C', the hook portion D pulls the cylindrical member C' in an arrow direction via the digital force gauge. A maximum load measured by the digital force gauge in a process in which the tube clamp 96*h* is unclamped is regarded as the unclamping strength of the air tube 96*g*.

Another test cylindrical member C' is formed of the same material as the cylindrical portion 96*dp* which is a connection destination of the air tube 96*g* and is 9.5 mm in outer diameter, which is the same as that of the cylindrical portion 96*dp*. Also with regard to another test cylindrical member C', a similar test was conducted and the unclamping strength was obtained.

TABLE 1

| COD*1 | DS*2 | DSP*3 |
|---|---|---|
| 8.5 mm | 67-89N | 0.8 MPa |
| 9.5 mm | 119-146N | 1.4 MPa |

*1"COD" is the cylindrical portion outer diameter.
*2"DS" is the unclamping strength.
*3"DSP" is the unclamping static pressure.

As shown in Table 1, in the case in which the outer diameter of the cylindrical portion 96*jp* is 9.5 mm, the unclamping strength of the air tube 96*g* was 67-89 N (6.7-8.9 kgf). On the other hand, in the case where the cylindrical portion 96*dp* is 9.5 mm, the unclamping strength of the air tube 96*g* was 119-146 N (11.9-14.6 kgf).

The unclamping strength somewhat varies also depending of difference among individuals of the air tube 96*g*, the cylindrical portion 96*jp* and the tube clamp 96*h*. As a result of a test that times was conducted ten times using the same material, however, a variation of the unclamping strength from an average of measured values was about 14% at the maximum.

In the case in which this result is applied to Embodiment 1, when the unclamping strength at the cylindrical portion 96*jp* of 8.5 mm in outer diameter is converted into a piping internal pressure, the internal pressure is about 0.57-0.63 MPa. Accordingly, even when the pressure adjusting valve 96*c* clogs and the pressure of the high-pressure air in the high-pressure air path 96 becomes high, one end portion of the air tube 96*g* is unclamped at the pressure P3=0.57-0.63 MPa, which is lower than the maximum discharge pressure P1=1.5 MPa of the compressor. The high-pressure air is discharged to the outside air from the cylindrical portion 96*jp* from which one end portion of the air tube 96*g* is unclamped, so that further pressure rise in the high-pressure air path 96 is avoided.

Further, the unclamping strength of 67-89 N at the cylindrical portion 96*jp* of 8.5 mm in outer diameter and the unclamping strength of 119-146 N at the cylindrical portion 96*dp* of 9.5 mm in outer diameter provide a difference of 20% or more even when a maximum of the former and a minimum of the latter are compared. For this reason, the pressure difference between the cylindrical portion 96*jp* of 8.5 mm in outer diameter and the cylindrical portion 96*dp* of 9.5 mm in outer diameter is 20% or more. For this reason, the air tube 96*g* is unclamped at the cylindrical portion 96*jp* prior to the cylindrical portion 96*dp* without causing unclamping movement thereof at the cylindrical portion 96*dp*. (119−89)/89=33%>20%

In Embodiment 1, the unclamping strength of one end portion of the air tube 96*g* is made smaller than the unclamping strength of the other end portion of the air tube 96*g*, and therefore, the one end portion of the air tube 96*g* is unclamped earlier than the other end portion during the pressure rise in the high-pressure air path. Further, connection of the end portions of other air tubes is constituted in the same manner as that of the other end portion of the air tube 96*g*, and therefore, of the end portions of all of the air tubes, the one end portion of the air tube 96*g* is first unclamped.

In Embodiment 1, the connected portion of the one end portion of the air tube 96*g* intentionally weakened in unclamping strength is used as a mechanical fuse for releasing the high-pressure air before the pressure of the high-pressure air generated by the air compressor 96*a* reaches the maximum pressure P1. The connecting position of the one end portion of the air tube 96*g* is determined in advance, and therefore, a maintenance property during a recovery operation by a service person becomes good.

Incidentally, the end portion of the air tube for which the unclamping pressure is set at a small value is not limited to the connected portion with the joint part 96*j*. The end portion may also be any place such that the internal pressure in the high-pressure air path 96 exceeds the pressure P2 and a problem arises. In the case in which protection requiring parts, such as an electric substrate, are provided in the neighborhood of the piping of the high-pressure air path 96, however, it is desirable that movement of the air tube 96*g* after the unclamping and leaping-off of the clamp 96*h* have no influence on these parts. For example, as shown in FIG. 4, a driver substrate E of the air compressor 96*a* exists in the neighborhood of the high-pressure air path 96. Therefore, in Embodiment 1, the air tube 96*g* is mounted to the joint part

96*j* partitioned from the driver substrate E by the partition wall (partition) 98. By doing so, even in the case where a band member 96*i* is broken, the driver substrate E can be protected from the leaping-off of the tube clamp 96*h*.

(Leaping-Off Prevention of Tube Clamp)

Figure 7:
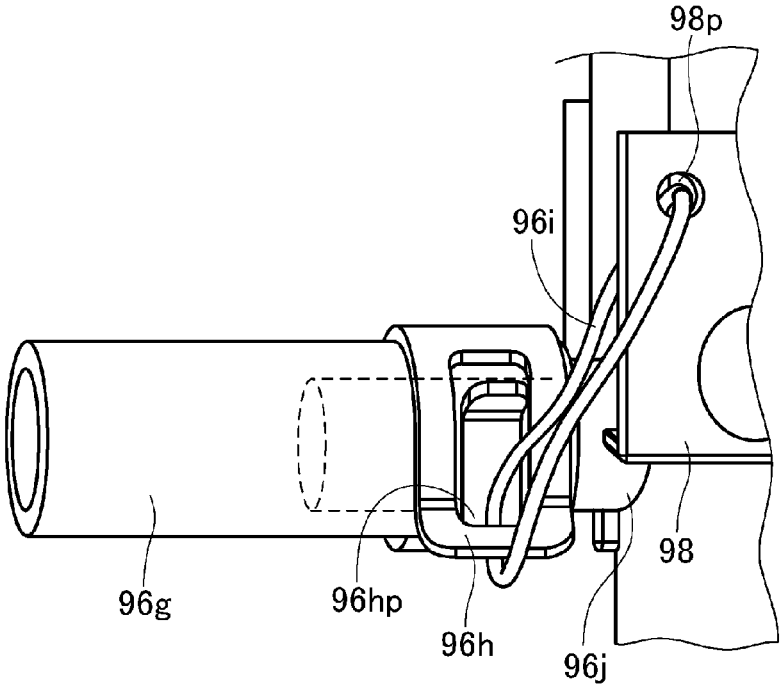
FIG. 7 is an illustration of a retaining member for a tube clamp.

FIG. 7 is an illustration of a retaining member for the tube clamp. As shown in FIG. 3, during pressure rise of the high-pressure air in the high-pressure air path, in the case in which the air tube 96*g* is unclamped vigorously from the cylindrical portion 96*jp*, there is a possibility that the tube clamp 96*h* leaps off with the vigor. At this time, there is a possibility that the tube clamp 96*h* which leaped off runs against a peripheral part and is broken or gets mixed in between devices on a circuit substrate and thus cannot be found.

For this reason, as shown in FIG. 7, the band member 96*i* which is a flexible retaining member is connected to the tube clamp 96*h*. The band member 96*i* has a length in which the unclamping of the air tube 96*g* at the cylindrical portion 96*jp* cannot be prevented, and a free end thereof is retained by the tube clamp 96*h*. The band member 96*i* connects a through hole 96*hp* provided in the tube clamp 96*h* and a through hole 98*h* of the partition wall 98 fixed to a destination joint part 96*j* for the air tube 96*g*. By this arrangement, even when the high-pressure air path 96 is in a high-pressure state and the air tube 96*g* is unclamped, a leaping-off range of the clamp 96*h* is limited and thus is readily found.

(Numerical Value of 20%)

Incidentally, even when all of the tube connected portions in the high-pressure air path 96 have the same specification, in relative comparison, one tube connected portion lowest in unclamping pressure exists. In this state, when the pressure in the high-pressure air path 96 exceeds an allowable pressure (second pressure P4), a plurality of tube connected portions start to be unclamped in a simultaneous process. Further, even when the tube connected portion lowest in unclamping pressure is unclamped prior to other tube connected portions, some of other tube connected portions are likely to be unclamped halfway in some cases. In this case, when the unclamped tube connected portion is restored, the tube connected portion lowest in unclamping pressure is switched to the tube connected portion likely to be unclamped halfway.

Further, even when all of the tube connected portions in the high-pressure air path 96 have the same specification, the unclamping pressure fluctuates due to a pressure difference, a temperature difference, the presence or absence of vibration for each of the tube connected portions, differences in direction of the air tube and tensile direction, and the like. For that reason, in Embodiment 1, the difference of 20% or more, evaluated in the pulling-off test shown in FIG. 6, is provided between one tube connected portion and all of other tube connected portions. Further, it was confirmed that the one tube connected portion is unclamped prior to other tube connected portions by artificially increasing the pressure in a normal temperature (20° C.) environment by providing the difference of 20% or more, evaluated in the pulling-off test shown in FIG. 6. Further, it was confirmed that all of other tube connected portions are subjected to visual inspection at the time of unclamping and there is no progress of the unclamping of each of other tube connected portions. For this reason, it would be considered that when the unclamped one tube connected portion is reconnected as before, there is no case that other tube connected portions are liable to be unclamped. Further, the unclamping order of the plurality of tube connected portions in the temperature rising process results from a relative difference in unclamping strength among the respective connected portions, and therefore, even when the environment changes to a low temperature (10° C.) environment or a high temperature (35° C.) environment, it would be considered that the one tube connected portion is unclamped prior to other tube connected portions in the pressure rising process.

Further, an experiment in which the pressure in the high-pressure air path 96 is artificially increased in a rest state of the image forming apparatus 100 was conducted, so that a relationship between the pulling-off force, evaluated in the pulling-off test shown in FIG. 6, and the unclamping pressure which is pressure in the high-pressure air path 96 when the tube connected portion is unclamped was checked. As a result, it turned out that two tube connected portions different in pulling-off force, evaluated in the pulling-off test shown in FIG. 6, by 20% also provide a difference of almost 20% in pulling-off pressure.

The plurality of connected portions in the high-pressure air path 96 includes two or more tube connected portions excluding the one tube connected portion. Other than the evaluation by the static pneumatic pressure application, also by the unclamping force when the tube connected portion is pulled in a direction along the cylindrical portion 96*jp* in a state in which the pressures in the inside and the outside of the cylindrical portion 96*jp* are the atmospheric pressure, the tube connected portion can be evaluated. When this evaluation is performed, in Embodiment 1, the smallest unclamping force of those of two or more tube connected portions is 20% or more larger than the unclamping force of the one tube connected portion designed so as to be unclamped.

(Effect of Embodiment 1)

In Embodiment 1, a relationship of P1>P3>P2 is set among the pressure P2 adjusted by the pressure adjusting valve 96*c*, the unclamping pressure P3 at the predetermined one end portion and the maximum discharge pressure P1. For this reason, at the time when the pressure adjusting valve 96*c* clogs and the internal pressure of the high-pressure air path 96 exceeds P2 and reaches P3, the predetermined one end portion is unclamped to discharge the high-pressure air to the outside, so that further pressure rise can be avoided.

In Embodiment 1, at the predetermined one end portion of the end portions of the plurality of air tubes, the unclamping pressure is set at a value smaller than those at any of other end portions by 20% or more. For this reason, when the pressure in the high-pressure air path 96 increases, the predetermined one end portion is unclamped prior to other end portions with reliability. For this reason, the unclamping air tube end portion is identified from the beginning, and the service person can find the unclamped portion sooner, and more easily perform a cause analysis, so that a maintenance property during a recovery operation is satisfactorily maintained. In the fixing device 9 in which the separation of the recording material P is assisted using the compressed air, it becomes possible to improve the maintenance property during restoration of the device.

In Embodiment 1, one connected portion (i.e., one end portion) low in pressure resistance is unclamped prior to other connected portions, so that at many connected portions other than the one end portion low in pressure resistance, any of trace, change and lowering in pressure resistance are not caused. For this reason, during the pressure rise after the unclamping of the air tube 96*g* is recovered, the air tube 96*g* is also unclamped at the cylindrical portion 96*jp* prior to other connected portions.

In Embodiment 1, the cylindrical portion 96*jp* is smaller in diameter than other tubular portions in the high-pressure air path 96. For this reason, a decrease in unclamping force at the cylindrical portion 96*jp* can be realized using the same air tube and the same tube clamp 96*h*.

In Embodiment 1, the air tube is a silicone rubber tube, and therefore, even when the air tube is used for a long term, the air tube is unclamped with high reproducibility to the pressure without sticking to the cylindrical portion 96*jp*. Further, the material is soft, and therefore, the unclamping force is easily controlled by a magnitude of the clamping force of the tube clamp.

In Embodiment 1, the partition wall 98 partitions the inside of the compressor unit into the space where the compressor 96*a* is disposed and the space where the cylindrical portion 96*jp* is disposed. For this reason, the tube clamp 96*h* and the air tube 96*g* which are unclamped from the cylindrical portion 96*jp* cannot enter the space where the compressor 96*a* is disposed.

Embodiment 2

Figure 8:
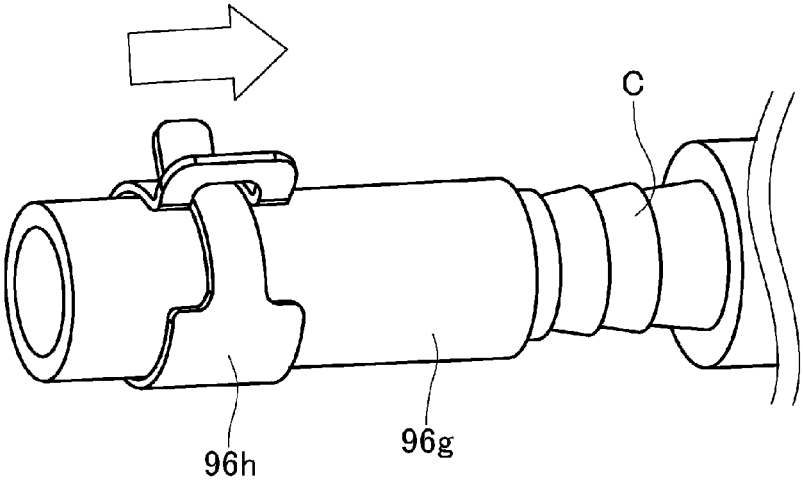
FIG. 8 is an illustration of a connected portion of an air tube in Embodiment 2.

FIG. 8 is an illustration of an air tube connected portion in Embodiment 2. As shown in FIG. 8, Embodiment 2 is constituted similarly as Embodiment 1 except that the cylindrical portion 96*dp* in which the air tube 96*g* is inserted is provided with a constriction. For this reason, in FIG. 8, constitutions in common with Embodiment 1 are represented by common symbols and will be omitted from redundant description.

As shown in FIG. 5, in Embodiment 1, all of the tubular portions which are destinations of the air tube connected portions have a straight cylindrical shape, and at a preliminarily selected one tube connected portion, the diameter of the tubular portion was made smaller than those of other tube connected portions, so that the difference in unclamping pressure was set. On the other hand, in Embodiment 2, the tubular portion has the straight cylindrical shape at the preliminarily selected one tube connected portion, and at all of other tube connected portions, an outer appearance of the destination tubular portion had a so-called volute (bamboo shoot) type having a ring-shaped unevenness. That is, at the destination tubular portion, a stepped portion functioning as a retainer for the air tube 96*g* was provided.

In Embodiment 2, the cylindrical portion 96*jp* is straight in shape, and other tubular portions are provided with the ring-shaped unevenness. For this reason, a decrease in unclamping force at the cylindrical portion 96*jp* can be realized using the same air tube and the same clamp 96*h*.

Embodiment 3

As shown in FIG. 5, a difference in unclamping force was set by a magnitude of a fastening force of the tube clamp. At a preliminarily selected one tube connected portion, an inner diameter dimension of the clamp 96*h* was made larger than those of other tube connected portions, so that the fastening force for the air tube 96*g* was made small and thus the unclamping strength was adjusted.

In Embodiment 3, the tube clamp 96*h* used at the cylindrical portion 96*jp* is smaller in fastening force than the tube clamps used at other the ring-shaped portions. For this reason, a decrease in unclamping force at the cylindrical portion 96*jp* can be realized using the same tubular portion and the same air tube.

Embodiment 4

Figure 9:
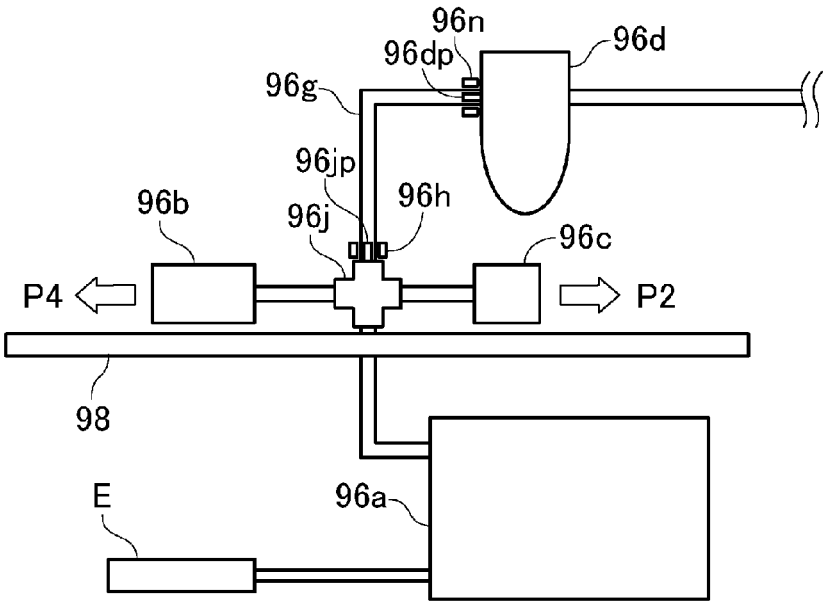
FIG. 9 is an illustration of a high-pressure air path in Embodiment 4.

FIG. 9 is an illustration of a high-pressure air path in Embodiment 4. As shown in FIG. 4, in Embodiment 1, the unclamping force of the air tube 96*g* is decreased only at the connected portion between the joint part 96*j* and the air tube 96*g*, and the connected portion was used as the mechanical fuse. On the other hand, as shown in FIG. 9, in Embodiment 4, in addition to the connected portion between the joint part 96*j* and the air tube 96*g*, the pressure-heating solenoid valve 96*b* was also used as the mechanical fuse for releasing the compressed air. As a result, safety is further enhanced against the unclamping of the air tube 96*g*.

As described above, the pressure-heating solenoid valve 96*b* discharges the high-pressure air, in the high-pressure air path 96, to the outside. The controller 99 actuates the pressure-heating solenoid valve 96*b* during actuation of the compressor 96*a* and lowers the pressure in the high-pressure air path 96 to atmospheric pressure, so that an actuating torque of the compressor 96*a* is decreased to a small value.

In addition to this, the pressure-heating solenoid valve 96*b* is mechanically actuated when the pressure in the high-pressure air path 96 reaches the allowable pressure (second pressure P4), and lowers the pressure in the high-pressure air path 96 to the atmospheric pressure. With no electrical signal, the pressure-heating solenoid valve 96*b* is actuated only by reacting with the pressure of the high-pressure air in the joint part 96*j*.

The pressure-heating solenoid valve 96*b*, which is an example of the pressure releasing valve, is connected with the high-pressure air path 96 and communicates with the ambient air when the pressure in the high-pressure air path 96 reaches the second pressure P4, and thus regulates the pressure in the high-pressure air path 96. The pressure-heating solenoid valve 96*b* (SMC Corporation, VX-240 DA) is a solenoid valve of a type in which the solenoid valve is closed during energization and is open during non-energization, and releases the compressed air remaining inside the piping after the compressor 96*a* is at rest. When a pressure difference between a primary side and a secondary side of the valve exceeds a maximum operating pressure difference, the pressure-heating solenoid valve 96*b* is forcedly placed in a valve open state. By using this arrangement, for example, as the pressure-heating solenoid valve 96*b*, a pressure-heating solenoid valve 96*b* of 0.4-0.5 MPa in maximum operating pressure difference can be used. By this arrangement, even when the pressure in the high-pressure air path 96 increases due to a malfunction of the air compressor 96*a* and the pressure adjusting valve 96*c*, at the time when a pressure value reaches 0.4-0.5 MPa, the pressure-heating solenoid valve 96*b* opens, so that the compressed air is released. Further, the pressure value of 0.4-0.5 MPa at this time is made smaller than a pressure value at which the clamp 96*h* is unclamped at the tube connected portion lowest in unclamping strength. For this reason, when the inner pressure of the piping increases, first, a safety mechanism of the pressure-heating solenoid valve 96*b* acts first, so that the compressed air is released. By this, when the second pressure is P4, the relationship P1>P3>P4>P2 holds. Accordingly, a possibility that the state of the clamp 96*h* reaches a leaping-off state can be further lowered, so that the safety can be further enhanced.

<Other Embodiments>

In Embodiment 1, as shown in FIG. 4, the compressor unit 80 was provided independently of the main assembly casing of the image forming apparatus 100 in which the fixing device 9 was mounted. However, the compressor 96*a* and the high-pressure air path 96 which are accommodated in the compressor unit 80 may also be provided in the main assembly casing of the image forming apparatus 100 in which the fixing device 9 is mounted. Or, the compressor 96*a* and the high-pressure air path 96 may also be accommodated by providing a casing of the fixing device 9 independent of the main assembly casing of the image forming apparatus 100.

In Embodiment 1, of the pair of rotatable members for forming the nip for carrying out the fixing process, the roller member and the endless belt were used, but a combination of the pair of rotatable members is not limited to the combination of the roller member and the endless belt. The combination of the pair of rotatable members may also be combinations of the heating roller and the pressing roller, the heating belt and the pressing roller, and the heating belt and the pressing belt.

The air tubes are not all required to be flexible, to be silicone rubber tubes, or to have the same diameter and the same thickness. It may only be required that at least one air tube is lower in unclamping pressure at one end than at the other end, and it may only be required that the pressure resistance at the other connected portion in the high-pressure air path 96 is higher than the unclamping pressure at one end.

INDUSTRIAL APPLICABILITY

According to the present invention, there is provided the image heating apparatus in which a time required for the recovery operation is shortened.

The invention claimed is:

1. An image heating apparatus comprising:

first and second rotatable members configured to form a nip for heating a toner image on a sheet;

a compressor configured to pressurize air;

an air nozzle configured to blow the air pressurized by said compressor onto said first rotatable member; and a supplying mechanism including a plurality of air tubes configured to supply the air from said compressor to said air nozzle, and a plurality of clamping portions configured to connect said plurality of air tubes to provide an air supply line from said compressor to said air nozzle, wherein said plurality of clamping portions includes a predetermined clamping portion capable of being unclamped by a predetermined internal pressure lower by 20% or more than an internal pressure at which other clamping portions, of said plurality of clamping portions, are unclamped.

2. An image heating apparatus according to claim 1, further comprising a plurality of relay members inserted into said plurality of air tubes and configured to provide the air supply line, wherein a diameter of a predetermined relay portion of a predetermined relay member that cooperates with said predetermined clamping portion is less than a diameter of other relay members of said plurality of relay members.

3. An image heating apparatus according to claim 1, further comprising a plurality of relay members inserted into said plurality of air tubes and cooperating with said plurality of clamping portions to connect said plurality of air tubes to provide the air supply line, wherein a clamping force of said predetermined clamping portion is less than a clamping force of other clamping portions of said plurality of clamping portions.

4. An image heating apparatus according to claim 1, wherein said supplying mechanism includes a pressure limiting mechanism configured to limit the internal pressure in said plurality of air tubes to be not greater than a predetermined pressure that is less than the predetermined internal pressure at which said predetermined clamping portion is unclamped.

5. An image heating apparatus according to claim 4, wherein said pressure limiting mechanism includes a pressure releasing valve.

6. An image heating apparatus according to claim 1, further comprising a partition configured to partition an inside of said image heating apparatus into a space in which said compressor is provided and a space in which the predetermined clamping portion is provided.

7. An image heating apparatus comprising:

first and second rotatable members configured to form a nip for heating a toner image on a sheet;

a compressor configured to pressurize air;

an air nozzle configured to blow the air pressurized by said compressor onto said first rotatable member; and a supplying mechanism including a plurality of air tubes and a plurality of clamping portions for connecting said air tubes, wherein a part of said plurality of air tubes and a part of said plurality of clamping portions provide an air supply line from said compressor to said air nozzle, and wherein said plurality of clamping portions include a predetermined clamping portion capable of being unclamped by an internal pressure lower by 20% or more than the internal pressures at which other clamping portions of the plurality of clamping portions are unclamped.

8. An image heating apparatus according to claim 7, wherein an additional part of said plurality of air tubes and an additional part of said plurality of clamping portions provide an additional air supply line to supply the air to an additional portion other than said air nozzle.

9. An image heating apparatus according to claim 8, wherein said additional portion includes a pressure limiting mechanism configured to limit the internal pressure in said plurality of air tubes to be not greater than a predetermined pressure that is less than the internal pressure at which the predetermined clamping portion is unclamped.

10. An image heating apparatus according to claim 7, further comprising a plurality of relay members inserted into said plurality of air tubes and cooperating with said plurality of clamping portions to connect said plurality of air tubes, wherein a diameter of a predetermined relay member cooperating with the predetermined clamping portion is less than a diameter of other relay members of the plurality of relay members.

11. An image heating apparatus according to claim 7, further comprising a plurality of relay members inserted into said plurality of air tubes and cooperating with said plurality of clamping portions to connect said plurality of air tubes, wherein a clamping force of said predetermined clamping portion is less than a clamping force of other clamping portions of said plurality of clamping portions.

12. An image heating apparatus according to claim 7, wherein said supplying mechanism includes a pressure limiting mechanism configured to limit the internal pressure in said plurality of air tubes to be not greater than a predetermined pressure that is less than the internal pressure at which said predetermined clamping portion is unclamped.

13. An image heating apparatus according to claim 12, wherein said pressure limiting mechanism includes a pressure releasing valve.

14. An image heating apparatus according to claim 7, further comprising a partition configured to partition an inside of said image heating apparatus into a space in which said compressor is provided and a space in which the predetermined clamping portion is provided.

15. An image heating apparatus comprising:

first and second rotatable members configured to form a nip for heating a toner image on a sheet;

a compressor configured to pressurize air;

an air nozzle configured to blow the air pressurized by said compressor onto said first rotatable member; and a supplying mechanism including a plurality of air tubes configured to supply the air from said compressor to said air nozzle, and a plurality of clamping portions for connecting said plurality of air tubes to provide an air supply line from said compressor to said air nozzle, wherein said plurality of clamping portions includes a clamping portion capable of being unclamped by an internal pressure lower by 20% or more than the internal pressures at which other clamping portions of said plurality of clamping portions are unclamped.

16. An image heating apparatus comprising:

first and second rotatable members configured to form a nip for heating a toner image on a sheet;

a compressor configured to pressurize air;

an air nozzle configured to blow the air pressurized by said compressor onto said first rotatable member; and a supplying mechanism including a plurality of air tubes and a plurality of clamping portions for connecting said plurality of air tubes, wherein a part of said plurality of air tubes and a part of said plurality of clamping portions provide an air supply line from said compressor to said air nozzle, and wherein said plurality of clamping portions includes a clamping portion capable of being unclamped by an internal pressure lower by 20% or more than the internal pressures at which other clamping portions of said plurality of clamping portions are unclamped.

17. An image heating apparatus comprising:

first and second rotatable members configured to form a nip for heating a toner image on a sheet;

a compressor configured to pressurize air;

an air nozzle configured to blow the air pressurized by said compressor onto said first rotatable member; and a supplying mechanism including a plurality of air tubes to supply the air from said compressor to said air nozzle, and a plurality of clamping portions for connecting said plurality of air tubes to provide an air supply line from said compressor to said air nozzle, wherein said plurality of clamping portions includes a first clamping portion capable of being unclamped by a lowest internal pressure of internal pressures at which clamping portions of said plurality of clamping portions are unclamped, and a second clamping portion capable of being unclamped by an internal pressure higher by 20% or more than the lowest internal pressure of the internal pressures at which said clamping portions of said plurality of clamping portions are unclamped.

18. An image heating apparatus comprising:

first and second rotatable members configured to form a nip for heating a toner image on a sheet;

a compressor configured to pressurize air;

an air nozzle configured to blow the air pressurized by said compressor onto said first rotatable member; and a supplying mechanism including a plurality of air tubes and a plurality of clamping portions for connecting said plurality of air tubes, wherein a part of said plurality of air tubes and a part of said plurality of clamping portions provide an air supply line from said compressor to said air nozzle, wherein said plurality of clamping portions includes a first clamping portion capable of being unclamped by a lowest internal pressure of internal pressures at which clamping portions of said plurality of clamping portions are unclamped, and a second clamping portion capable of being unclamped by an internal pressure higher by 20% or more than the lowest internal pressure of internal pressures at which said clamping portions of said plurality of clamping portions are unclamped.

* * * * *